US011489244B2

(12) United States Patent
Radchenko et al.

(10) Patent No.: US 11,489,244 B2
(45) Date of Patent: Nov. 1, 2022

(54) SPIRAL ULTRA-WIDEBAND MICROSTRIP QUADRATURE DIRECTIONAL COUPLER

(71) Applicant: AKCIONERNOE OBSHESTVO "MICROVOLNOVYE SISTEMY", Moscow (RU)

(72) Inventors: Aleksey Vladimirovich Radchenko, Reutov (RU); Vladimir Vasilievich Radchenko, Mytischi (RU)

(73) Assignee: AKCIONERNOE OBSHESTVO MICROVOLNOVYE SISTEMY, Moscow (RU)

( * ) Notice: Subject to any disclaimer, the term of this patent is extended or adjusted under 35 U.S.C. 154(b) by 0 days.

(21) Appl. No.: 17/257,205

(22) PCT Filed: Sep. 20, 2019

(86) PCT No.: PCT/RU2019/000656

§ 371 (c)(1),
(2) Date: Dec. 30, 2020

(87) PCT Pub. No.: WO2020/071956

PCT Pub. Date: Apr. 9, 2020

(65) Prior Publication Data

US 2021/0159580 A1 May 27, 2021

(30) Foreign Application Priority Data

Oct. 3, 2018 (RU) ..... RU2018134902

(51) Int. Cl.
*H01P 1/18* (2006.01)
*H01P 5/18* (2006.01)

(52) U.S. Cl.
CPC ..... *H01P 5/184* (2013.01)

(58) Field of Classification Search
CPC ..... H01P 5/18; H01P 5/184; H01P 5/5185
See application file for complete search history.

(56) References Cited

U.S. PATENT DOCUMENTS 3,516,024 A 2/1970 Lange
3,999,150 A * 12/1976 Caragliano ..... H01P 5/185 333/116

(Continued)

FOREIGN PATENT DOCUMENTS

RU 1808152 A3 4/1993
RU 2042990 C1 8/1995
RU 2340050 C1 11/2008

OTHER PUBLICATIONS

PCT Search Report for International Application No. PCT/RU2019/000656, dated Jan. 9, 2020, 3 pp.

(Continued)

*Primary Examiner* — Stephen E. Jones
(74) *Attorney, Agent, or Firm* — The Roy Gross Law Firm, LLC; Roy Gross

(57) ABSTRACT

The invention relates to the field of microwave engineering, and in particular, to waveguide-type coupling devices consisting of two coupled lines. The invention can be utilized as a hardware component for thin-film integrated high-frequency units (such as splitter/adder circuits), UHF power amplifiers, couplers, radiofrequency multiplexers, phase shifters, filters and other units in wireless devices used for various purposes. The benefit of the invention claimed lies in increase in efficiency of utilization of the usable area of a dielectric substrate and decrease in overall dimensions of the device and widening of the operating frequency band. This benefit is achieved by inclusion of two electromagnetically coupled microstrip transmission lines to the helical ultra-wideband microstrip quadrature directional coupler, which are designed as flat bilifar helices and are arranged on a dielectric substrate, the backside of which is partially or completely metalized or suspended over a metal surface. The couple differs from other analogous devices in its helices which have more than one turns with one helix of the (Continued)

coupler rotated relative to the other around their common center, while clearances between the coupled transmission lines and their cross-sectional dimensions are constant.

5 Claims, 8 Drawing Sheets

(56) References Cited

U.S. PATENT DOCUMENTS

| | | | | |
|---|---|---|---|---|
| 6,346,863 | B2 * | 2/2002 | Sasaki | H01P 5/185 333/116 |
| 7,567,147 | B2 * | 7/2009 | Toujo | H01P 5/185 333/116 |
| 7,714,679 | B2 * | 5/2010 | Jiang | H01P 5/185 333/116 |
| 8,760,240 | B2 * | 6/2014 | Yehezkely | H03H 7/48 333/119 |
| 2009/0189712 | A1 | 7/2009 | Jiang | |

OTHER PUBLICATIONS

PCT Written Opinion for International Application No. PCT/RU2019/000656, dated Jan. 9, 2020, 2 pp.

* cited by examiner

SPIRAL ULTRA-WIDEBAND MICROSTRIP QUADRATURE DIRECTIONAL COUPLER

CROSS REFERENCE TO RELATED APPLICATIONS

This application is a National Phase of PCT Patent Application No. PCT/RU2019/000656 having International filing date of Sep. 20, 2019, which claims the benefit of priority of Russian Patent Application No. 2018134902, filed Oct. 3, 2018, the contents of which are all incorporated herein by reference in their entirety.

FIELD OF THE INVENTION

The invention belongs to the field of microwave engineering, and in particular, to waveguide-type coupling devices consisting of two coupled lines. The invention can be utilized as a hardware component for thin-film integrated high-frequency units (such as splitter/adder circuits), UHF power amplifiers, couplers, radiofrequency multiplexers, phase shifters, filters and other units in wireless devices used for various purposes.

BACKGROUND OF THE INVENTION

The relevance of this technical solution is pre-conditioned by the ever increasing requirements to high-frequency units of communication and radar systems regarding their bandwidth, minituarization and use of top-notch technologies. In order to comply with the current requirements, it is essential to embody planar directional couplers and UHF power splitters/adders with a relative passband exceeding 0.60 (exceeding an octave) with high output of usable products.

Directional couplers are widely used in microwave engineering. They are mainly intended for directional coupling of some high-frequency energy from the main tract to an auxiliary one. These devices are characterized by coupling of unidirectional waves only, i.e. they couple either waves propagating forward or waves propagating in reverse direction in the main tract. Operation of such devices is based on excitation of several waves in an auxiliary tract, which are phase-shifted so that amplitudes of waves propagating in a desirable direction interfere and, thus, are summarized, while any waves traveling in an undesirable direction are mutually compensated. To put it differently, a directional coupler is a four-branch device comprising two sections of a transmission line, in which some energy of an electromagnetic wave propagating in the main transmission line (main channel) is tapped to an auxiliary transmission line (auxiliary channel) by coupling elements and is transmitted in this auxiliary line in a specific direction. By the degree of coupling of the main and auxiliary channels, directional couplers can be divided into two types: a) Couplers with strong coupling (coupling of less than 10 dB); and b) Couplers with weak coupling (coupling exceeding 10 dB). In 3 dB directional couplers, if UHF signal is sent to one of its inputs, its power is evenly distributed between a predetermined pair of outputs, while no power is supplied to the fourth branch, aka an "isolated" or "untied" branch (it is assumed that all outputs are loaded to a matched load). It should be noted that the pair of outputs of such 3 dB directional coupler, between which the power is distributed, also share a decoupling circuit.

In order to make directional couplers smaller and to maximize the use of top-notch technologies in them, such couplers are designed on the basis of microstrip lines, i.e.

asymmetrical strip transmission lines used to transmit electromagnetic waves in air or, commonly, in a dielectric medium (substrate) along two or more conductors shaped as thin strips and plates. The lines have been dubbed "microstrips" since, thanks to the high dielectric permeability of the substrate, thickness of the substrate and cross-sectional dimensions of the strip are much less than free-space wavelength. In a microstrip line, quasi-TEM waves propagate and electric lines of force pass both inside and outside the dielectric. Advantages of the microstrip lines and various devices based on such lines also include opportunities for automation of production processes using printed board, hybrid and film integrated microcircuit technology.

Prior art: The microstrip directional coupler shown in FIG. 1 has already been described (Maloratskiy L. G., Yavich L. R. "Design and Calculation of UHF Elements Based on Strip Lines", Moscow, "Sovetskoye Radio" Publishing House, 1972, FIG. 2.14,6). The coupler comprises two electromagnetically coupled lines, which are formed in parallel to each other on a dielectric substrate. The coupler considered here features a 90° phase shift between electric field strength vectors at outputs 3 and 2 of the branches. Thus, such couplers are called quadrature couplers. The coupler can be manufactured using thin-film technology on "Polycore", "22XC" etc. substrates. Bandwidth of the coupler is determined by the attainable coupling factor, the value of which depends on the clearance between the electromagnetically coupled microstrip lines formed on one side of the dielectric substrate. For "Polycore"-type ceramics with relative dielectric permeability of $\varepsilon_r=10$, the factor will not exceed 0.5 with tract characteristic impedance $\rho_0=50$ Ohm, which on logarithmic scale matches the level of 6 dB. Due to its broadbandness, the coupler in question is characterized by bandwidth of 20 to 25%, which is acceptable for narrow-band devices only.

Further, a tandem microstrip directional coupler shown in FIG. 2 has been described (Maloratskiy L. G. "Minituarization of UHF Elements and Devices". Moscow, "Sovetskoye Radio" Publishing House, 1976. FIG. 2.16). In essence, this coupler represents a functional unit comprising two microstrip couplers identical to those described above. Thanks to a specific order of connection of poles in these couplers, the authors managed to embody a "tandem" microstrip coupler with passband of 60 to 65%. However, both constitutive couplers must have no direct electromagnetic connection with each other and, thus, in their practical embodiment the constitutive couplers must be arranged at a significant distance from each other and, therefore, such "tandem" coupler will be rather large and its scope of use in microwave engineering will be limited.

SUMMARY OF THE INVENTION

The tandem directional coupler shown in FIG. 3 (Lekhitser A. Y., Fedosov A. N. "Tandem Directional Couplers and Units Based on Them", "Radiopromyshlennost" Journal, Moscow, 2004, p. 148-154, FIG. 6) is the closest in its essence to the claimed invention. This coupler in essence represents a tandem coupler described above (see FIG. 2). However, the coupling sidelines of this coupler have zero length. At the same time, the microstrip transmission lines are formed as a flat single-turn bilifar helix. Jumpers are used to output signals from the center of the helix. Small capacitors can be installed at input and output points of such coupler in order to reduce loss at the operating range limits. Such solutions contribute to widening of the operating band in comparison to the tandem couplers described above.

Nevertheless, the already known designs of tandem couplers share some disadvantages—their operating band is usually limited to 1.5 octaves, and increase in coupling of coupled lines by decreasing clearances between them results in worse standing wave ratio (SWR) of output branches and in a significant difference in signal amplitudes in output branches at the center frequency.

The benefit of the invention claimed lies in increase in efficiency of utilization of the usable area of a dielectric substrate and decrease in overall dimensions of the device and widening of its operating frequency band.

This benefit is achieved by inclusion of two electromagnetically coupled microstrip transmission lines to the helical ultra-wideband microstrip quadrature directional coupler, which are designed as flat bilifar helices and are arranged on a dielectric substrate, the backside of which is partially or completely metalized or suspended over a metal surface. The coupler differs from other analogous devices in its helices which have more than one turns with one helix of the coupler rotated relative to the other around their common center, while clearances between the coupled transmission lines and their cross-sectional dimensions are constant.

Figure 1:
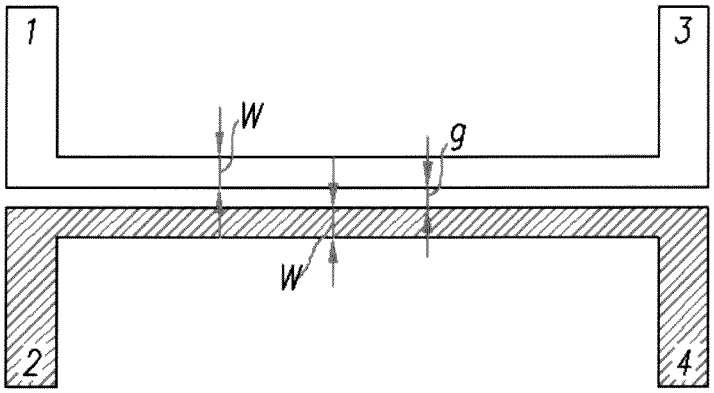
Fig. 1 PRIOR ART
FIG. 1 shows a microstrip directional coupler known from Maloratskiy L. G., Yavich L. R. "Design and Calculation of UHF Elements Based on Strip Lines" with cross-sectional dimension W of the microstrip lines and clearance g between them. Coupler leads (branches) are hereafter designated as follows: 1— input; 2— coupled output; 3— direct output; and 4—isolated output.
Figure 2:
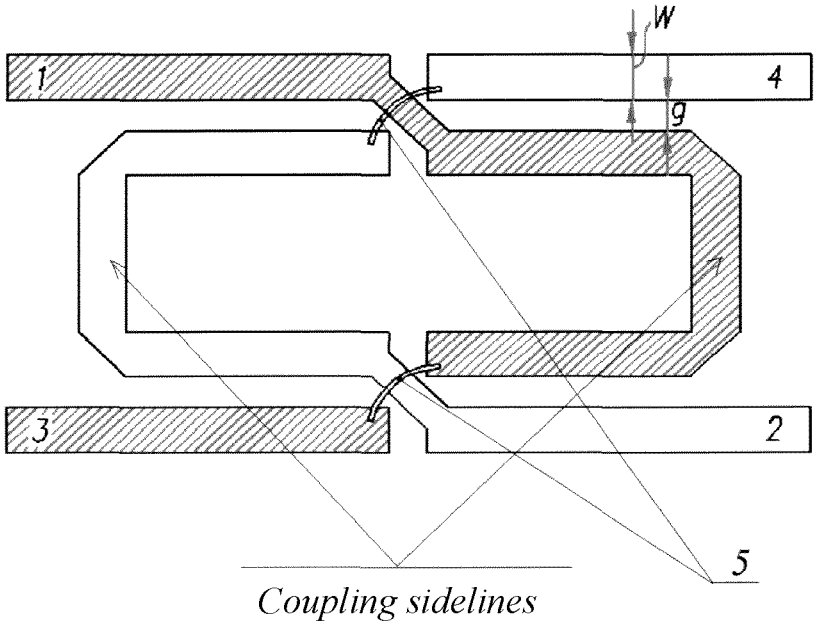
Fig. 2 PRIOR ART
FIG. 2 shows a tandem microstrip directional coupler known from Maloratskiy L. G. "Minituarization of UHF Elements and Devices" with cross-sectional dimension W of the microstrip lines and clearance g between them. Jumpers 5 are used to connect sections of the microstrip lines.
Figure 3:
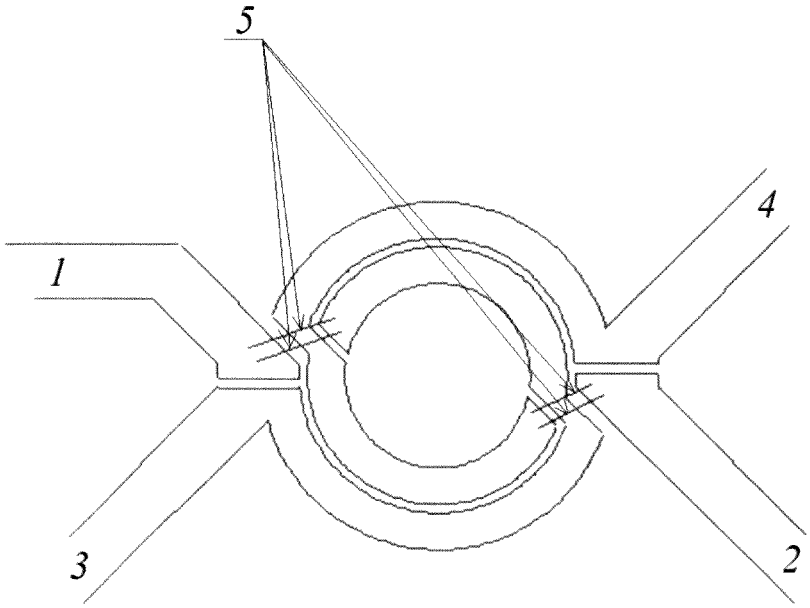
Fig. 3 PRIOR ART
FIG. 3 shows a tandem directional coupler known from Lekhitser A. Y., Fedosov A. N. "Tandem Directional Couplers and Units Based on Them", in which microstrip transmission lines are formed as a flat single-turn bilifar helix. Jumpers 5 are used to output signals from the center of the helix.
Figure 4:
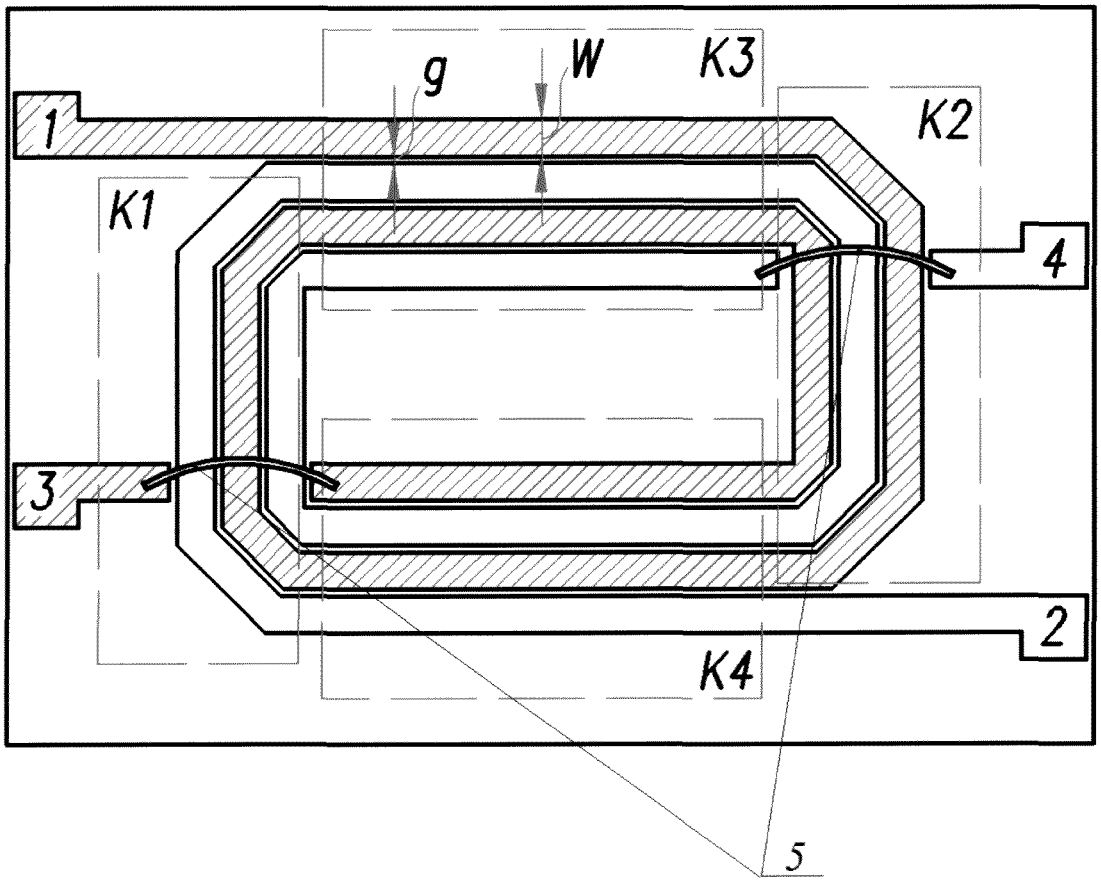
FIG. 4 shows top view of a helical ultra-wideband microstrip quadrature directional coupler with transmission lines formed as a bilifar helix with constant cross-sectional dimensions W of coupled lines and clearances g between them, and with planar line bend angle of 45 degrees. Jumpers 5 are used to output signals from the center of the helix. The figure shows main coupling areas— K1 and K2, where each area has three coupled lines, and K3 and K4, where each area has four coupling lines.
Figure 5:
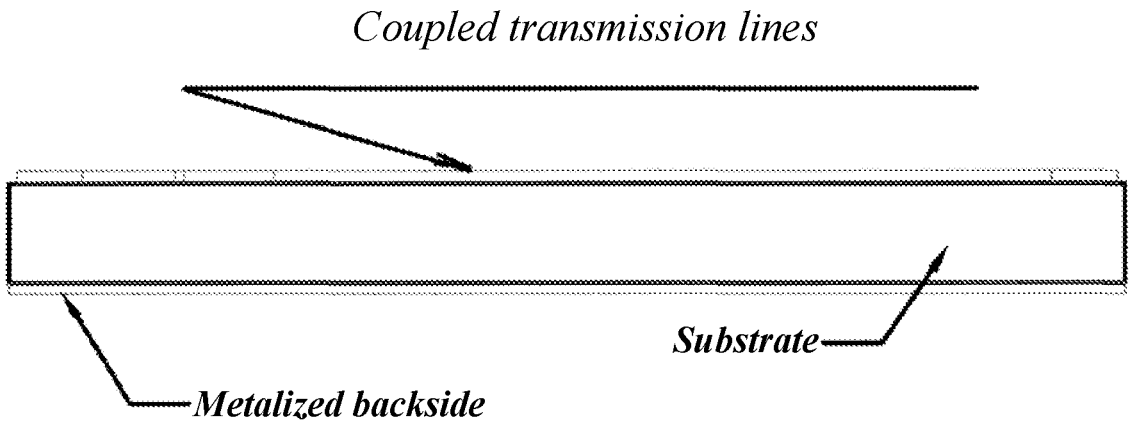
FIG. 5 shows front view of a coupler with transmission lines formed as a bilifar helix with constant cross-sectional dimensions of coupled lines and clearances between them and with planar line bend angle of 45 degrees. The coupled transmission lines are arranged on one side of a dielectric substrate, while the other side of the substrate is metalized.
Figure 6:
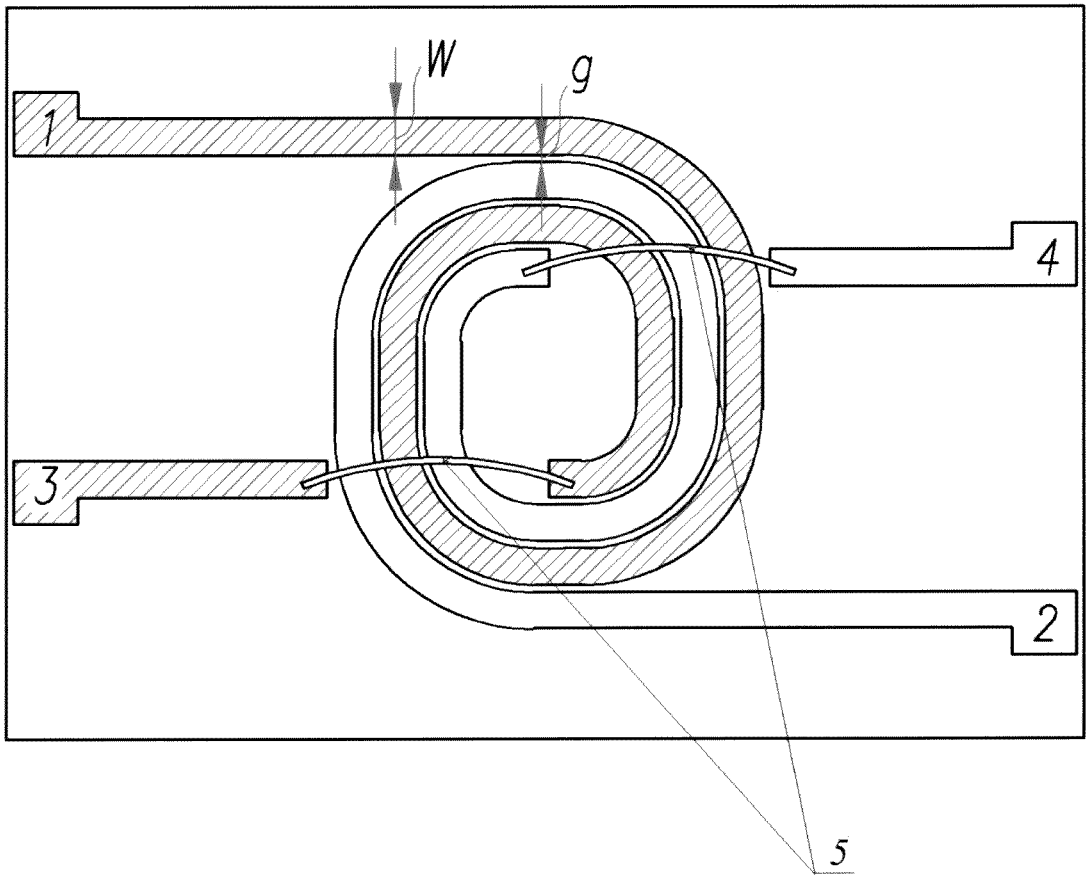
FIG. 6 shows top view of a coupler with transmission lines formed as a bilifar helix with constant cross-sectional dimensions W of coupled lines and clearances g between them and with planar lines with curved bends. Jumpers 5 are used to output signals from the center of the helix.

The options of formation of coupled lines shown in FIG. 4 to FIG. 6 are not exhaustive. Thus, for instance, the bilifar helix can be formed of planar lines curved along their entire length.

Figure 7:
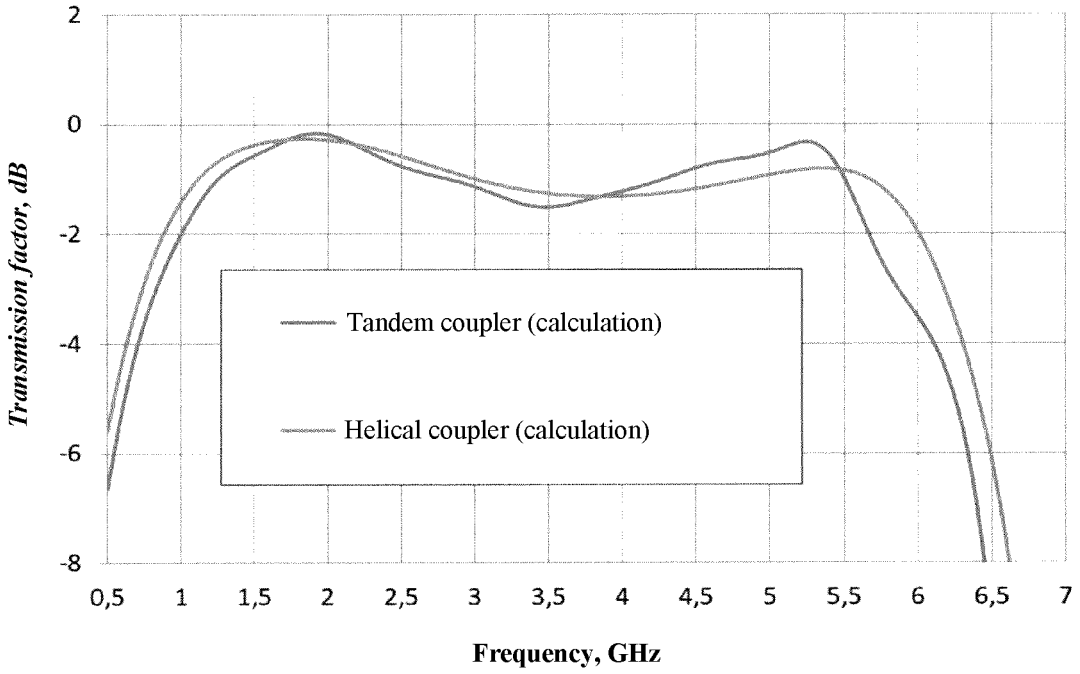

FIG. 7 shows cross-plots of transmission factors against frequency of a tandem coupler and a helical coupler with constant cross-sectional dimensions of coupled transmission lines and clearances between them (with a regular structure), which are loaded to 50 Ohm, in splitting/adding.

Figure 8:
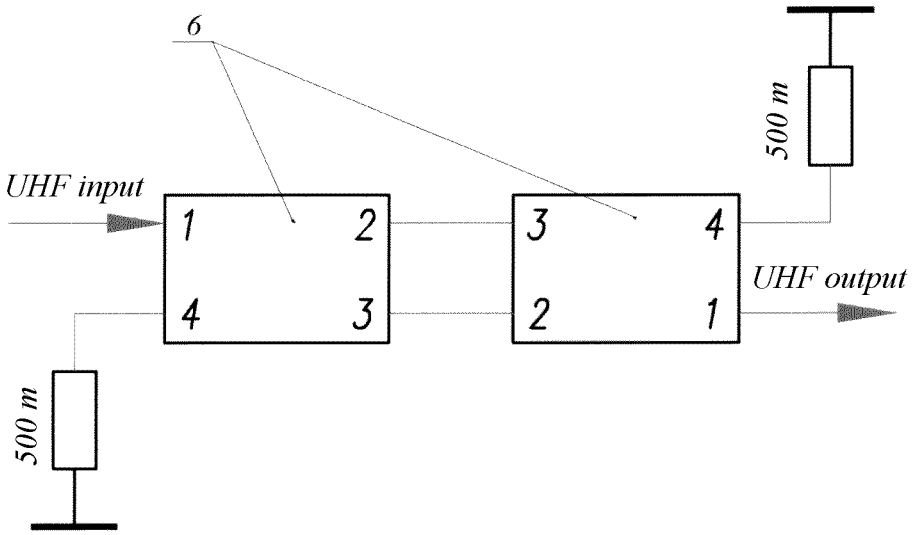

FIG. 8 shows a splitting/adding diagram of 3-dB couplers 6 loaded to a matched load.

DETAILED DESCRIPTION OF THE INVENTION

The directional coupler design is based on use of two electromagnetically coupled microstrip lines formed as flat bilifar helices with more than one turns; at the same time, one helix is rotated relative to the other around their common center. As it is shown in FIG. 4 and FIG. 6, jumpers 5 (wire, foil, hybrid-grown or any other jumpers) can be used to output signals from the center of the helix.

In its essence, such coupler is a tandem connection of multiple sections of coupled lines, which is one of well-known ways to widen the operating frequency band of tandem directional couplers (tandem connection of coupled lines is described in Meshchanov V. P., Feldstein A. L. "Automated Design of UHF Directional Couplers", "Svyaz" Publishing House, Moscow, 1980, p. 96-97). Thus, for instance, FIG. 4 shows four main coupling areas of a coupler with transmission lines made up of linear sections of a bilifar helix with constant cross-sectional dimensions W of coupled lines and clearances g between them, and with planar line bend angle of 45 degrees. Coupling areas K1 and K2 have three coupled lines each, and areas K3 and K4 have four coupled lines each. Cascade connection of the four areas with different coupling levels in such coupler provides for significant widening of its operating frequency band (up to 2.5 octaves) in comparison to conventional tandem couplers with two coupling cascades.

FIG. 7 shows estimated splitting/adding loss probability graphs for three types of 1-6 Hz 3 dB couplers, one branch of which is loaded to a matched load. The diagram of splitting/adding measurement is provided in FIG. 8.

Since the electromagnetically coupled lines are coiled into a helix, the coupler is at least two to three times smaller than its prototype (such decrease in the dimensions is in inverse proportion to the number of turns of the bilifar helix) and, therefore, the efficiency of utilization of the substrate usable area is significantly higher.

Thus, the essential features of this technical solution provide for significant widening of the operating frequency range of the coupler and, therefore, make it smaller and improve efficiency of utilization of the substrate usable area, which ensure the claimed benefits of the invention.

What is claimed is:

1. A helical ultra-wideband microstrip quadrature directional coupler comprising:

two electromagnetically coupled microstrip transmission lines designed as flat bilifar helices arranged on a dielectric substrate with the backside completely metalized or suspended over a metal surface, wherein the helices have more than one turn with one helix of the coupler rotated relative to the other around their common center, while clearances between the coupled transmission lines and their cross-sectional dimensions are constant, and wherein the helices have a planar line bend angle of about 45 degrees at at least one turn.

2. The helical ultra-wideband microstrip quadrature directional coupler of claim 1, wherein the number of turns of the helices is greater than one, and wherein one helix runs in the opposite direction to the other about a common center.

3. A ultra-wideband helical microstrip quadrature directional coupler, comprising;

a dielectric substrate defined by a topside and a completely metalized underside; and two electromagnetically coupled microstrip transmission lines configured as flat bilifar helices, wherein the helices having more than one turn with one helix rotated relative to the other helix around their common center with the dielectric clearances between the transmission lines and their cross-sectional dimensions being constant, wherein the space utilization of the dielectric substrate and coupler frequency bandpass versus signal loss are improved, wherein the helices have a planar line bend angle of about 45 degrees at at least one turn, and wherein the coupler is operative at frequencies below fifteen gigahertz.

4. The quadrature coupler of claim 3; wherein the transmission lines are suspended above the dielectric substrate.

5. A helical ultra-wideband microstrip quadrature directional coupler comprising:

two electromagnetically coupled microstrip transmission lines designed as flat bilifar helices arranged on a dielectric substrate with the backside completely metalized or suspended over a metal surface, wherein the helices have more than one turn with one helix of the coupler rotated relative to the other around their common center, while clearances between the coupled transmission lines and their cross-sectional dimensions are constant, and wherein the helices have a planar line that are curved at at least one turn.

* * * * *